US010264359B2

(12) United States Patent
Kawai et al.

(10) Patent No.: US 10,264,359 B2
(45) Date of Patent: Apr. 16, 2019

(54) SPEAKER DAMPER AND SPEAKER UNIT

(71) Applicant: JVC KENWOOD Corporation, Yokohama-shi, Kanagawa (JP)

(72) Inventors: Hiroaki Kawai, Yokohama (JP); Akira Shigeta, Yokohama (JP); Satoshi Tomizawa, Yokohama (JP)

(73) Assignee: JVC KENWOOD CORPORATION, Kanagawa (JP)

( * ) Notice: Subject to any disclaimer, the term of this patent is extended or adjusted under 35 U.S.C. 154(b) by 256 days.

(21) Appl. No.: 15/451,191

(22) Filed: Mar. 6, 2017

(65) Prior Publication Data

US 2017/0180867 A1 Jun. 22, 2017

Related U.S. Application Data

(63) Continuation of application No. PCT/JP2015/003284, filed on Jun. 30, 2015.

(30) Foreign Application Priority Data

Sep. 5, 2014 (JP) ..... 2014-181413

(51) Int. Cl.
*H04R 1/02* (2006.01)
*H04R 7/26* (2006.01)
*H04R 9/04* (2006.01)

(52) U.S. Cl.
CPC ..... *H04R 7/26* (2013.01); *H04R 1/023* (2013.01); *H04R 9/043* (2013.01)

(58) Field of Classification Search
CPC ..... H04R 7/26; H04R 1/023; H04R 9/043
USPC ..... 181/166; 381/398, 403, 404, 354
See application file for complete search history.

(56) References Cited

U.S. PATENT DOCUMENTS 7,082,667 B2 * 8/2006 Auerbach ..... H04R 1/06 29/594
7,382,892 B2 * 6/2008 Chan ..... H04R 9/043 381/403
8,813,906 B2 * 8/2014 Ohara ..... H04R 9/043 181/166
2005/0254682 A1 * 11/2005 Maekawa ..... H04R 9/043 381/404

FOREIGN PATENT DOCUMENTS

JP H09-154199 6/1997
JP 2006094087 A * 4/2006
JP 2009049719 A * 3/2009

* cited by examiner

*Primary Examiner* — Jeremy A Luks
(74) *Attorney, Agent, or Firm* — Procopio, Cory, Hargreaves & Savitch LLP

(57) ABSTRACT

In a speaker damper, art sections are disposed on warp reference lines and warp reference lines. Straight sections are disposed so as to intersect intermediate reference lines at right angles. By adopting this configuration, wave parts can be adjusted so that they are less likely to expand/contract on the warp reference lines and the warp reference lines in comparison with related-art concentric circular wave parts. Further, the wave parts can be adjusted so that they are more likely to expand/contract on the intermediate reference lines. In this way, the speaker damper can perform uniform vibrating motions throughout the entire speaker damper with a simple configuration.

5 Claims, 8 Drawing Sheets

SPEAKER DAMPER AND SPEAKER UNIT

CROSS REFERENCE TO RELATED APPLICATION

This application is a Continuation Application from PCT Application No. PCT/JP2015/003284 filed Jun. 30, 2015, and claims the benefit of priority from Japanese patent application No. 2014-181413, filed on Sep. 5, 2014, the disclosure of which is incorporated herein in its entirety by reference.

BACKGROUND

The present invention relates to a speaker damper in which a plurality of wave parts are formed in a damper base that is formed by impregnating a fabric material formed by weaving warp and weft in an interlaced manner with a resin, and a speaker unit using the speaker damper.

In related-art speaker dampers, a wavelike shape is adopted in order to give a margin for their vibrating motions. In general, this wavelike shape is formed so that concentric circles are formed in the plan view (i.e., as viewed from the top). A cloth-like material that is formed by weaving warp and weft is used for the damper. Wave parts (or wavy parts) are press-formed so that the damper can expand and contract. A fabric material used as a raw material is impregnated with a resin. The above-described dumber base material is affected by the property of threads that are woven into the warp and the weft and a resin solvent that is used to increase the strength of the fabric material. The strength and the flexibility of the damper in the directions along (i.e., in parallel with) the threads, which intersect each other at right angles, are different from those of the damper in the directions inclined from the threads by 45 degrees. Therefore, when the damper performs expanding/contracting motions, different expanding/contracting motions occur in the above-described different directions. When the magnitude of the expanding/contracting motions of the damper is increased, the damper is more likely to bend (or warp) in the directions in which the flexibility is large. In contrast to this, the damper is less likely to bend (or warp) in the directions in which the flexibility is small. As a result, the damper is distorted. Such distorted motions make smooth vibrating motions performed by the damper difficult.

Therefore, Japanese Unexamined Patent Application Publication No. H9-154199 discloses a technique for solving such a problem. In a speaker damper disclosed in this publication, an amount of collapse of a damper base in directions inclined from threads by 45° is increased when wave parts are press-formed in the damper base. In this way, the rigidity of the speaker damper in the directions inclined from the threads by 45° is improved.

SUMMARY

However, local collapse-deformations are unavoidable in the damper base in the above-described related-art speaker damper. Further, the amount by which the damper base is collapsed needs to be highly accurate. Therefore, the amount by which the damper base is collapsed tends to become non-uniform. As a result, the speaker damper tends to cause non-uniform vibrating motions.

An exemplary embodiment is a speaker damper including a group of waves including a plurality of wave parts formed in a damper base, the damper base being formed by impregnating a fabric material with a resin, the fabric material being formed by weaving warp and weft in an interlaced manner, the plurality of wave parts being concentric with a circular central opening, in which at least one wave part of the group of waves is a rectangular wave part including:

four straight sections intersecting four intermediate reference lines, the four intermediate reference lines connecting points at which the warp and the weft intersect each other and extending from a center of the central opening, the four straight sections extending while intersecting the four intermediate reference lines at right angles;

two first arc sections connecting ends of adjacent straight sections to each other, the two first arc sections intersecting warp reference lines and having their centers on the warp reference lines, the warp reference lines extending from the center of the central opening along the warp; and two second arc sections connecting ends of adjacent straight sections to each other, the two first arc sections intersecting waft reference lines and having their centers on the waft reference lines, the waft reference lines extending from the center of the central opening along the weft.

DETAILED DESCRIPTION

Preferred exemplary embodiments of speaker dampers according to the present invention are explained hereinafter with reference to the drawings. Note that a speaker unit according to the present invention is a speaker unit in which a speaker damper based on one of the below-explained exemplary embodiments is used.

First Exemplary Embodiment

Figure 1A:
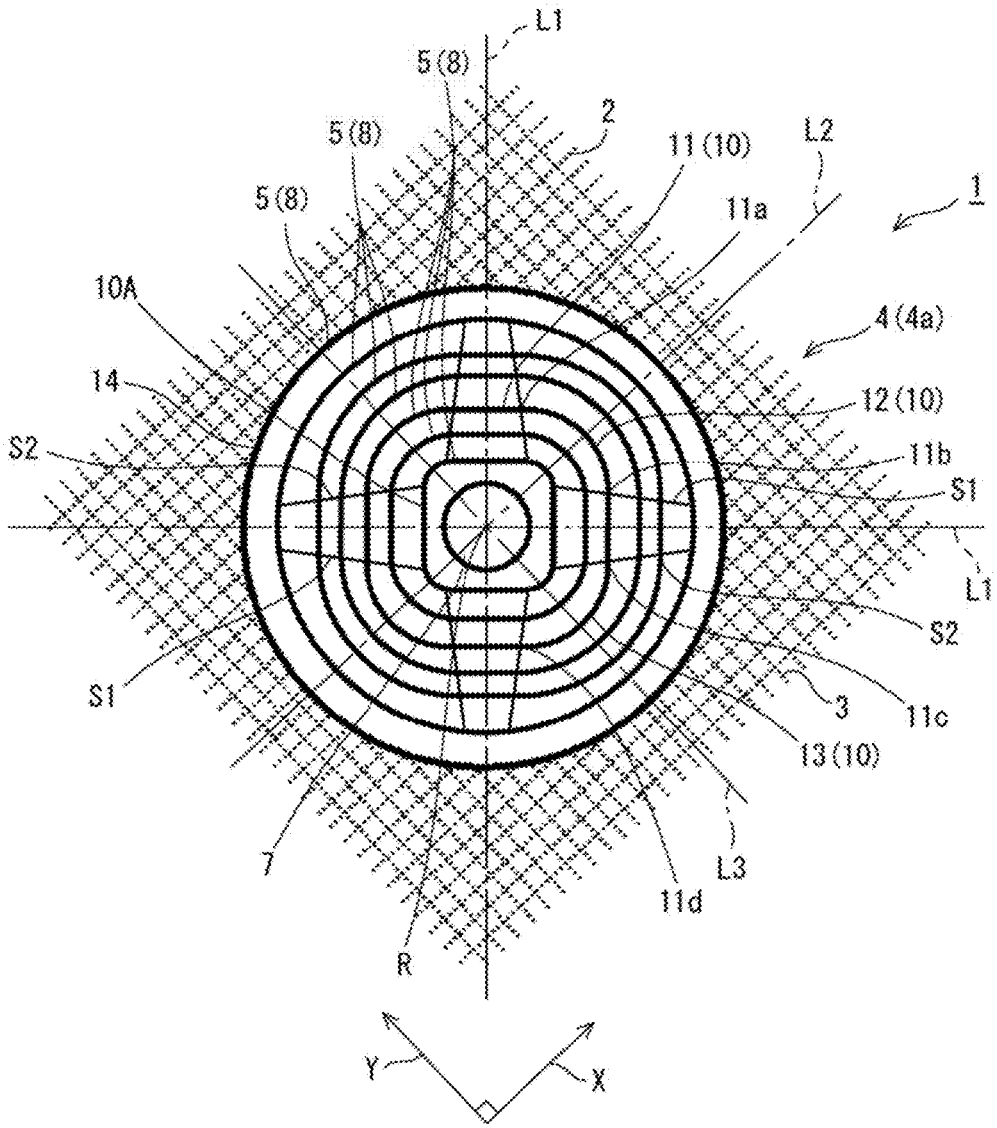
FIG. 1A is a plan view showing a first exemplary embodiment of a speaker damper according to the present invention.
Figure 1B:
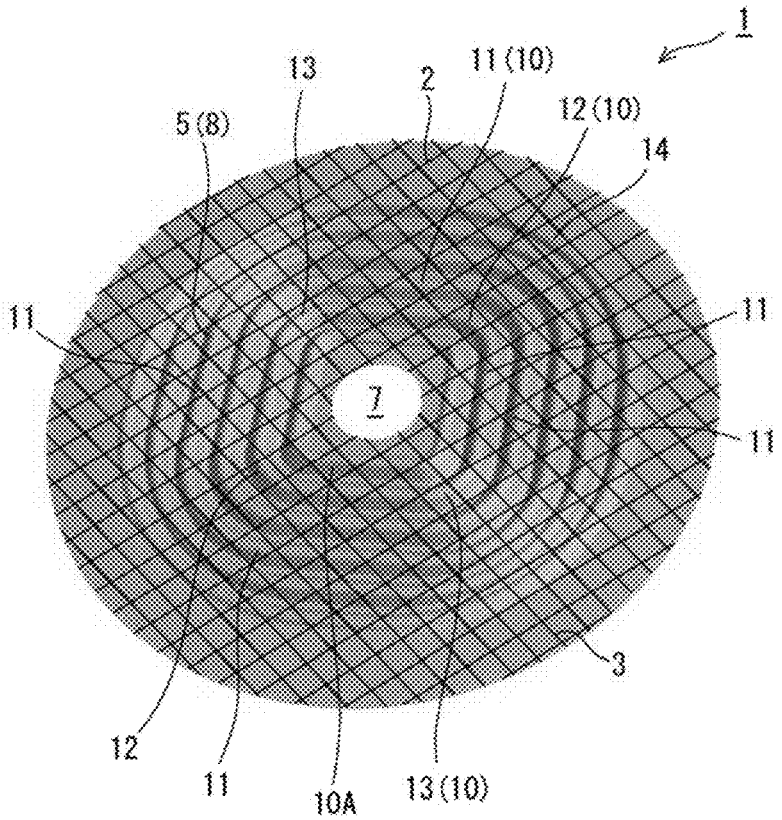
FIG. 1B is a perspective view showing the first exemplary embodiment of the speaker damper according to the present invention.

As shown in FIGS. 1A and 1B, a damper raw material 4 used for a speaker damper 1 is formed by impregnating a fabric material 4*a* with a resin. The fabric material 4*a* is a plain weave or a twill weave in which warp 2 and weft 3 intersect (or interlace) each other. The damper raw material 4 is subjected to press-forming. As a result, a plurality of ring-shaped wave parts 5 are formed. Note that a symbol X indicates a direction in which the warp 2 extends. A symbol Y indicates a direction in which the weft 3 extends. The warp 2 and the weft 3 intersect with each other at 90 degrees. The angle between the warp 2 and the weft 3 is not limited to 90 degrees. However, each of the exemplary embodiments is explained on the assumption that the angle between the warp 2 and the weft 3 is 90 degrees A voice coil bobbin (not shown) is inserted into and fixed in a circular central opening 7 formed in the circular speaker damper 1. A group of waves (hereinafter called a "wave group") 8 is formed from the vicinity of the central opening 7 to the vicinity of the periphery of the speaker damper 1. Each of the wave parts 5 has a C-shape or a U-shape in cross section. The wave parts 5 protrude from the front and the back of the speaker damper 1. Each wave part 5 continues in a circumferential direction of the speaker damper 1. In this way, the wave group 8 is formed. Note that ridges of mountains (i.e., protrusions) are indicated by solid lines in FIG. 1A.

The wave group 8 includes at least one rectangular wave part 10. Four straight sections 11 of this rectangular wave part 10 connect points at which the warp 2 and the weft 3 intersect each other. Each of the straight sections 11 intersects one of four intermediate reference lines L1, which extends from the center R of the central opening 7, at a right angle. In this exemplary embodiment, the intermediate reference lines L1 extend from the center of the central opening 7 in directions inclined from the warp 2 and the weft 3 at 45 degrees. Further, two first arc sections 12 of the rectangular wave part 10 connect ends 11*a* and 11*b* of adjacent straight sections 11 to each other. The first arc sections 12 intersect warp reference lines L2 extending from the center R of the central opening 7 along the warp 2. The first arc sections 12 have their centers on the warp reference lines L2.

Further, two second arc sections 13 of the rectangular wave part 10 connect ends 11*c* and 11*d* of adjacent straight sections 11 to each other. The second arc sections 13 intersect weft reference lines L3 extending from the center R of the central opening 7 along the weft 3. The second arc sections 13 have their centers on the weft reference lines L3.

In the wave group 8, the lengths of the straight sections 11 of the rectangular wave parts 10 decrease as the distance from the central opening 7 increases. The straight sections 11 extend in parallel with each other. Each of the straight sections 11 is disposed (i.e., extends) in an area between one of boundary lines S1 that extend from the central opening 7 toward the periphery of the speaker damper on boundaries between the straight sections 11 and the first arc sections 12 and one of boundary lines S2 that extend from the central opening 7 toward the periphery of the speaker damper on boundaries between the straight sections 11 and the second arc sections 13.

In the wave group 8 shown in FIGS. 1A and 1B, a rectangular wave part 10A is disposed adjacent to the central opening 7. A circular wave part 14 is disposed adjacent to the periphery of the speaker damper in the wave group 8. The lengths of the straight sections 11 decrease from the central opening 7 toward the periphery of the speaker damper in the wave group 8. The shapes of the wave parts 5 gradually change from the rectangular shape of the rectangular wave part 10A to the circular shape of the circular wave part 14.

In an ordinary speaker damper having concentric circular wave parts, the wave parts are more likely to expand/contract on the warp reference lines L2 and the weft reference lines L3. Meanwhile, the wave parts are less likely to expand/contract on the intermediate reference lines L1. We have paid attention to the above-described phenomenon and hence disposed the arc sections 12 and 13 on the warp reference lines L2 and the weft reference lines L3 in the speaker damper 1 according to this exemplary embodiment. The straight sections 11 are disposed so that they intersect the intermediate reference lines L1 at right angles. By adopting the above-described configuration, the wave parts 5 according to this exemplary embodiment are adjusted so that they are less likely to expand/contract on the warp reference lines L2 and the weft reference lines L3 in comparison with the related-art concentric circular wave parts. Further, the straight sections 11 are adjusted so that the wave parts 5 are more likely to expand/contract on the intermediate reference lines L1.

As a result, the speaker damper 1 has a simple configuration and can perform uniform vibrating motions throughout the entire speaker damper 1. In particular, when the size of the speaker damper 1 is increased, the diameter of fibers of the warp 2 and the weft 3 increases. Therefore, the rigidity of the damper raw material 4 itself increases. Since a large speaker damper 1 performs large vibrating motions, the vibrating motions are more likely to cause a difference between the expansion/contraction of the wave parts 5 on the intermediate reference lines L1 and that of the wave parts 5 on the warp reference lines L2 and the weft reference lines L3. Therefore, when the size of the speaker damper 1 is increased, the lengths of the straight sections 11 and the arc sections 12 and 13 are changed (i.e., adjusted) as appropriate with consideration given to the characteristic of the damper raw material 4.

Second Exemplary Embodiment

Figure 2A:
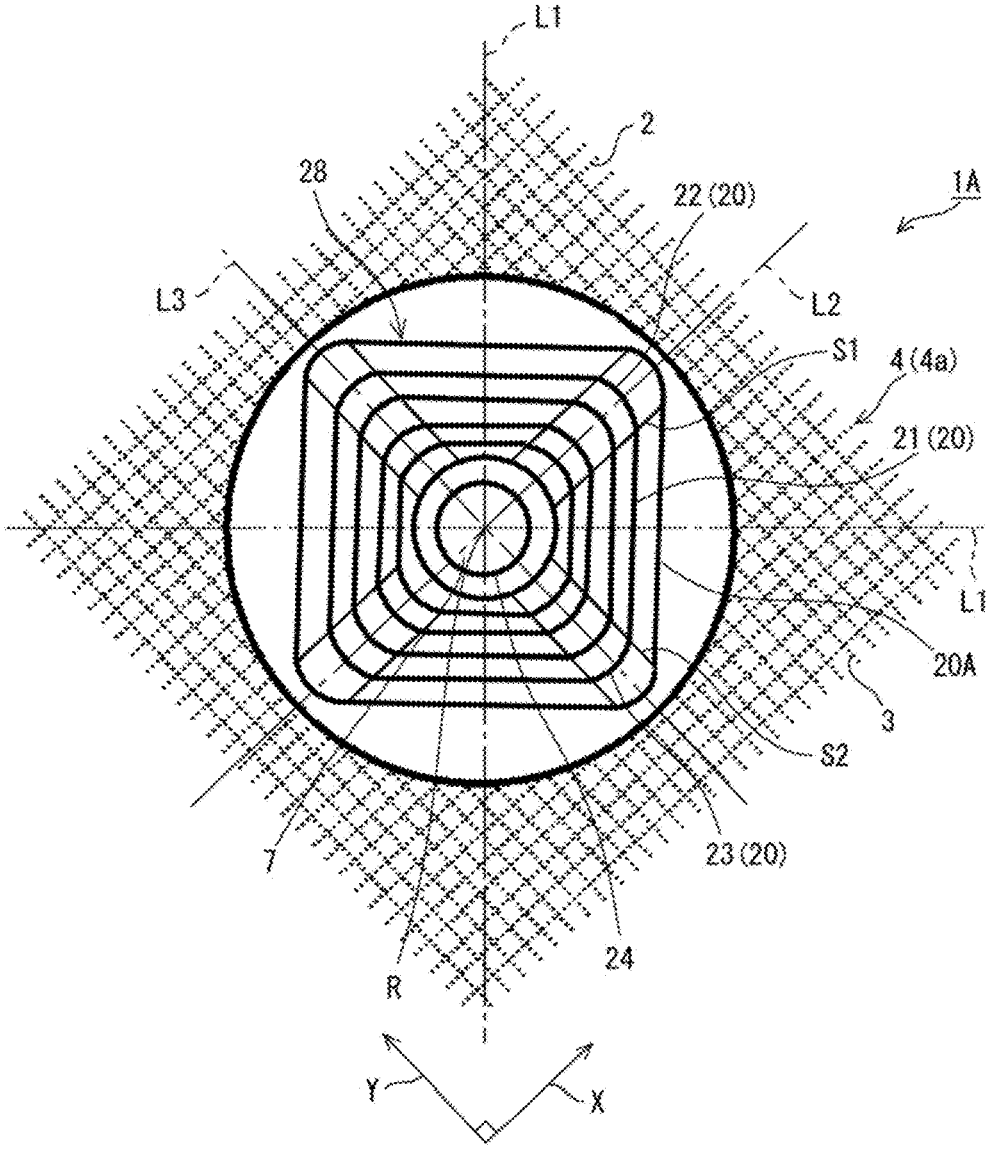
FIG. 2A is a plan view showing a second exemplary embodiment of a speaker damper according to the present invention.
Figure 2B:
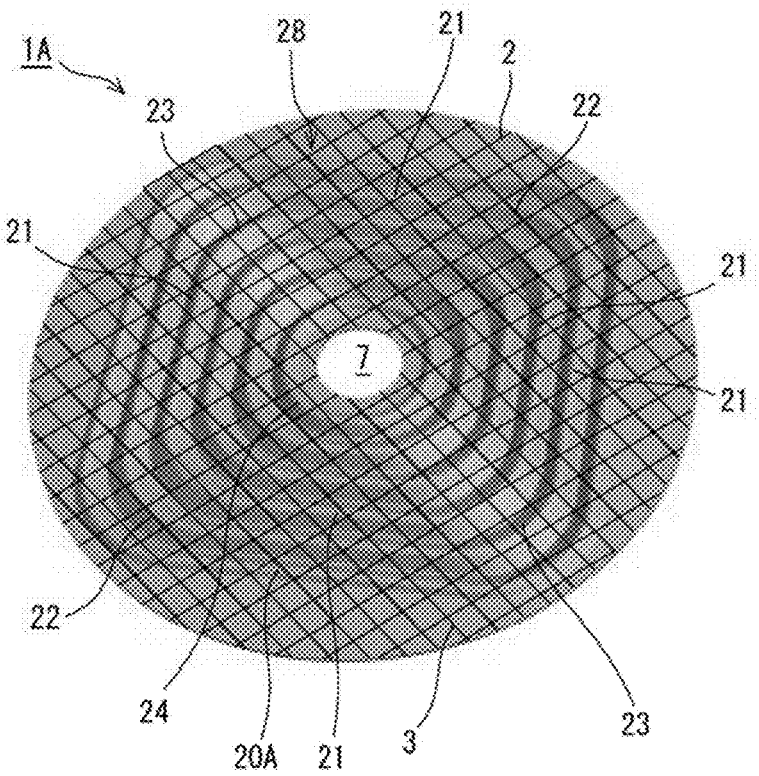
FIG. 2B is a perspective view showing the second exemplary embodiment of the speaker damper according to the present invention.

As shown in FIGS. 2A and 2B, the lengths of straight sections 21 of rectangular wave parts 20 increase as the distance from the central opening 7 increases in a wave group 28 of a speaker damper 1A. The straight sections 21 extend in parallel with each other. Further, each of the straight sections 21 is disposed (i.e., extends) in an area between one of boundary lines S1 that extend from the central opening 7 toward the periphery of the speaker damper on boundaries between the straight sections 21 and first arc sections 22 and one of boundary lines S2 that extend from the central opening 7 toward the periphery of the speaker damper on boundaries between the straight sections 21 and second arc sections 23.

In the wave group 28 shown in FIGS. 2A and 2B, a circular wave part 24 is disposed adjacent to the central opening 7. A rectangular wave part 20A is disposed adjacent to the periphery of the speaker damper in the wave group 28. The lengths of the straight sections 21 increase from the central opening 7 toward the periphery of the speaker damper in the wave group 28. As a result, the shapes of the wave parts gradually change from the circular shape of the circular wave part 24 to the rectangular shape of the rectangular wave part 20A.

Third Exemplary Embodiment

Figure 3A:
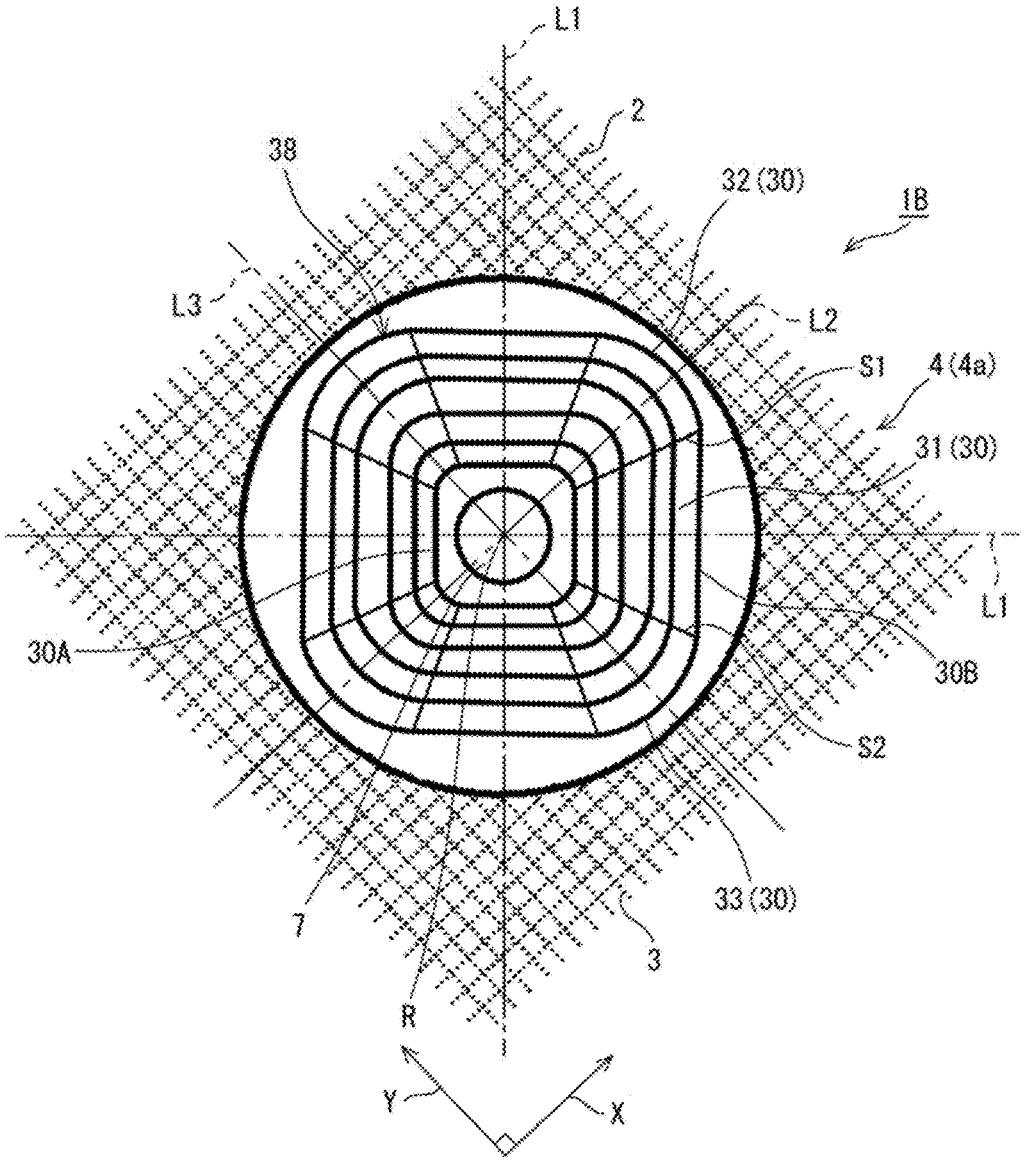
FIG. 3A is a plan view showing a third exemplary embodiment of a speaker damper according to the present invention.
Figure 3B:
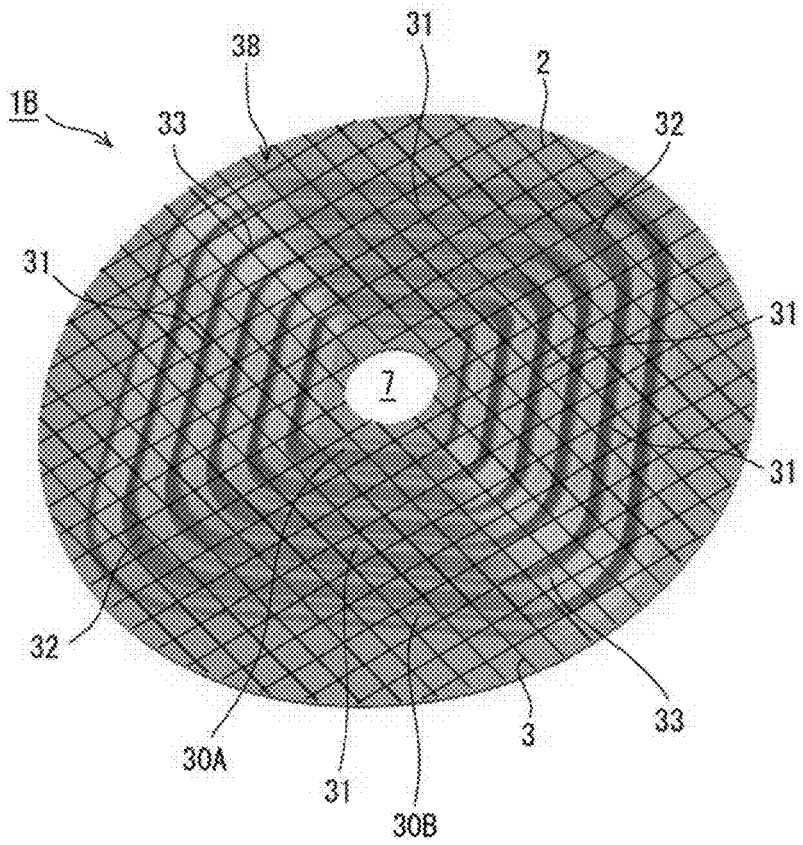
FIG. 3B is a perspective view showing the third exemplary embodiment of the speaker damper according to the present invention.

As shown in FIGS. 3A and 3B, the lengths of straight sections 31 of rectangular wave parts 30 gradually increase as the distance from the central opening 7 increases in a wave group 38 of a speaker damper 1B. Note that the lengths of the straight sections 31 may be equal to each other. The straight sections 31 extend in parallel with each other. Further, each of the straight sections 31 is disposed (i.e., extends) in an area between one of boundary lines S1 that extend from the central opening 7 toward the periphery of the speaker damper on boundaries between the straight sections 31 and first arc sections 32 and one of boundary lines S2 that extend from the central opening 7 toward the periphery of the speaker damper on boundaries between the straight sections 31 and second arc sections 33.

In the wave group 38 shown in FIGS. 3A and 3B, a rectangular wave part 30A is disposed adjacent to the central opening 7. A rectangular wave part 30B is disposed adjacent to the periphery of the speaker damper in the wave group 38. The lengths of the straight sections 21 increase from the central opening 7 toward the periphery of the speaker damper. The shapes of the rectangular wave parts change so as to gradually become lager from the shape of the rectangular wave part 30A.

Fourth Exemplary Embodiment

Figure 4A:
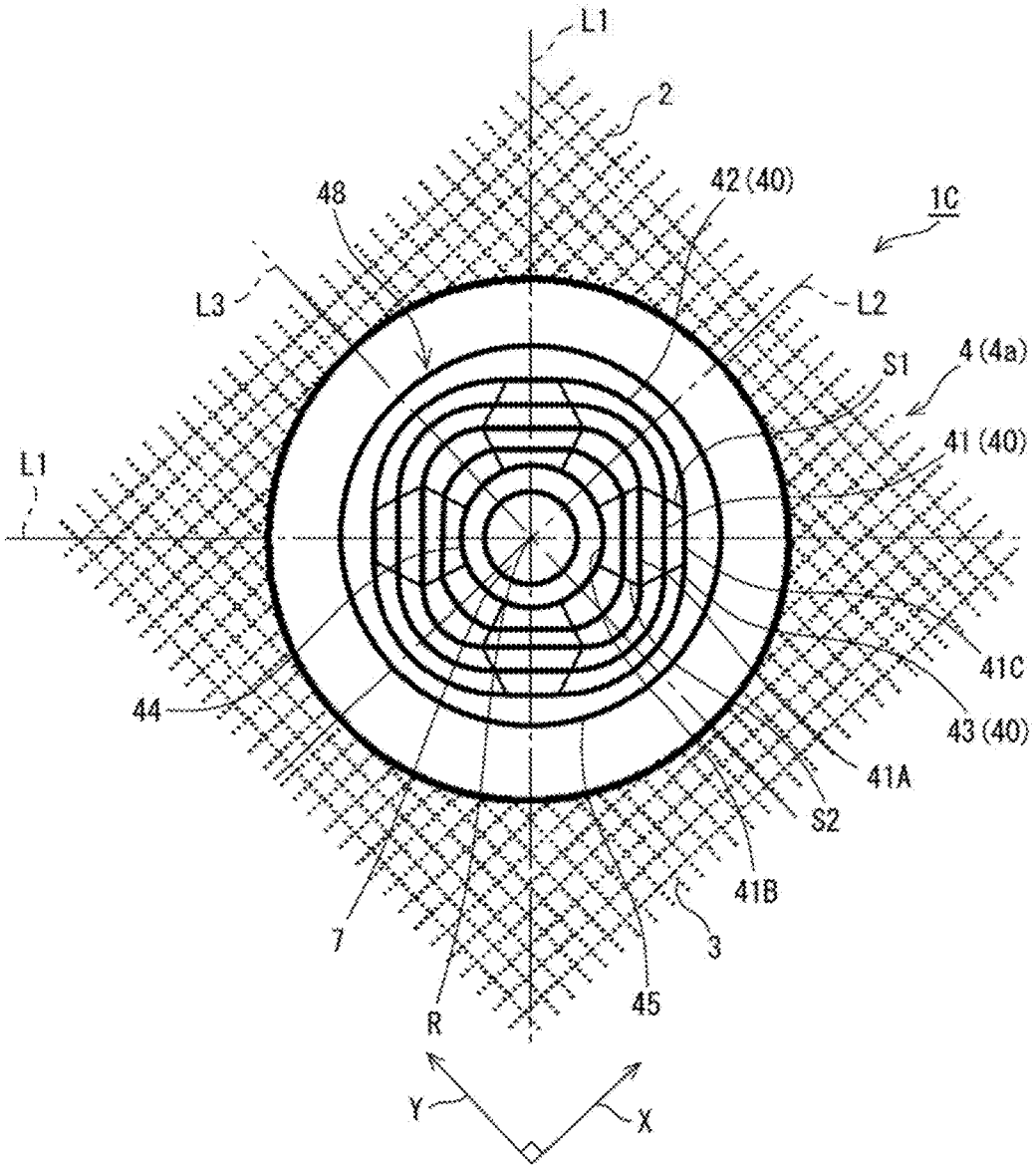
FIG. 4A is a plan view showing a fourth exemplary embodiment of a speaker damper according to the present invention.
Figure 4B:
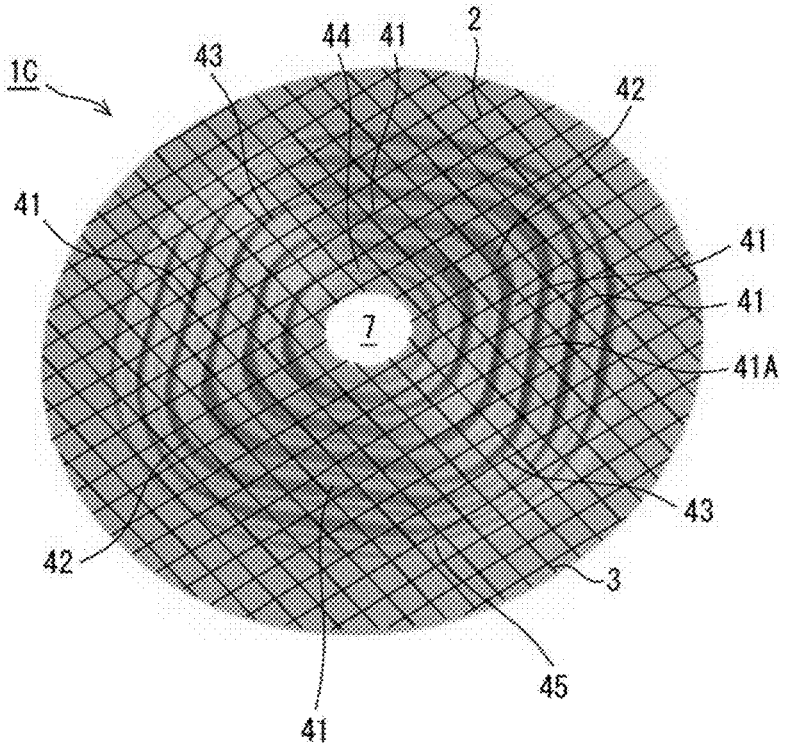
FIG. 4B is a perspective view showing the fourth exemplary embodiment of the speaker damper according to the present invention.

As shown in FIGS. 4A and 4B, the lengths of straight sections 41 of rectangular wave parts 40 gradually increase as the distance from the central opening 7 increases in a wave group 48 of a speaker damper 1C. Then, the lengths of the straight sections 41 gradually decrease as the distance from the central opening 7 increases when the distance exceeds the halfway point. The straight sections 41 extend in parallel with each other. Each of the straight sections 41 is disposed (i.e., extends) in an area between one of V-shaped boundary lines S1 that extend from the central opening 7 toward the periphery of the speaker damper on boundaries between the straight sections 41 and first arc sections 42 and one of V-shaped boundary lines S2 that extend from the central opening 7 toward the periphery of the speaker damper on boundaries between the straight sections 41 and second arc sections 43.

In the wave group 48 shown in FIGS. 4A and 4B, a circular wave part 44 is disposed adjacent to the central opening 7. A circular wave part 45 is disposed adjacent to the periphery of the speaker damper in the wave group 48. The longest straight sections 41A are disposed roughly at the middle between the innermost circular wave sections 44 and the outermost circular wave sections 45. In wave group 48, the lengths of straight sections 41 of rectangular wave parts 40 change so as to gradually increase from the innermost straight sections 41B toward the longest straight sections 41A located at the middle. Further, the lengths of the straight sections 41 change so as to gradually decrease from the longest straight sections 41A toward the outermost straight sections 41C.

By interposing the rectangular wave part(s) 40, the wave parts of the wave group 48 change from the small circular wave part 44 located on the inner side to the large circular wave part 45 located on the outer side.

The present invention is not limited to the above-described exemplary embodiments, and the below-shown various modifications can be made without departing from the scope and spirit of the present invention.

For example, the above-described straight section may be substantially straight. That is, the above-described straight section may be slightly curved. According to above exemplary embodiments, it is possible to make non-uniform vibrating motions less likely to occur with a simple configuration.

The present invention can provide a speaker damper that has a simple configuration and is less likely to cause non-uniform vibrating motions, and a speaker unit using the speaker damper.

What is claimed is:

1. A speaker damper comprising a group of waves comprising a plurality of wave parts formed in a damper base, the damper base being formed by impregnating a fabric material with a resin, the fabric material being formed by weaving warp and weft in an interlaced manner, the plurality of wave parts being concentric with a circular central opening, wherein at least one wave part of the group of waves is a rectangular wave part comprising:

four straight sections intersecting four intermediate reference lines, the four intermediate reference lines connecting points at which the warp and the weft intersect each other and extending from a center of the central opening, the four straight sections extending while intersecting the four intermediate reference lines at right angles;

two first arc sections connecting ends of adjacent straight sections to each other, the two first arc sections intersecting warp reference lines and having their centers on the warp reference lines, the warp reference lines extending from the center of the central opening along the warp; and two second arc sections connecting ends of adjacent straight sections to each other, the two first arc sections intersecting waft reference lines and having their centers on the waft reference lines, the waft reference lines extending from the center of the central opening along the weft.

2. The speaker damper according to claim 1, wherein in the group of waves, lengths of the straight sections of the rectangular wave parts decrease as a distance from the central opening increases.

3. The speaker damper according to claim 1, wherein in the group of waves, lengths of the straight sections of the rectangular wave parts increase as a distance from the central opening increases.

4. The speaker damper according to claim 1, wherein in the group of waves, lengths of the straight sections of the rectangular wave parts increase as a distance from the central opening increases and then decrease as the distance further increases.

5. A speaker unit using a speaker damper according to claim 1.

* * * * *